US010422105B2

(12) United States Patent
Gross et al.

(10) Patent No.: US 10,422,105 B2
(45) Date of Patent: Sep. 24, 2019

(54) EQUALIZER FOR A MINING SHOVEL

(71) Applicant: Harnischfeger Technologies, Inc., Wilmington, DE (US)

(72) Inventors: Matthew L. Gross, West Allis, WI (US); Richard Nicoson, Hartford, WI (US)

(73) Assignee: Joy Global Surface Mining Inc, Milwaukee, WI (US)

( * ) Notice: Subject to any disclaimer, the term of this patent is extended or adjusted under 35 U.S.C. 154(b) by 12 days.

(21) Appl. No.: 14/727,041

(22) Filed: Jun. 1, 2015

(65) Prior Publication Data

US 2015/0345106 A1 Dec. 3, 2015

Related U.S. Application Data

(60) Provisional application No. 62/006,450, filed on Jun. 2, 2014.

(51) Int. Cl.
*E02F 3/58* (2006.01)
*E02F 3/30* (2006.01)
(Continued)

(52) U.S. Cl.
CPC ..... *E02F 3/58* (2013.01); *E02F 3/30* (2013.01); *E02F 3/4075* (2013.01); *E02F 9/006* (2013.01); *Y10T 29/49828* (2015.01)

(58) Field of Classification Search
CPC ... E02F 3/60; E02F 3/40; E02F 3/4075; E02F 3/58; E02F 3/46; E02F 3/30; E02F 9/006; Y10T 29/49828
See application file for complete search history.

(56) References Cited

U.S. PATENT DOCUMENTS 665,682 A * 1/1901 Hetlesaeter ..... E02F 3/4075 414/726
1,609,372 A * 12/1926 Lichtenberg ..... E02F 3/40 414/726
(Continued)

FOREIGN PATENT DOCUMENTS

CN 1203998 A 1/1999
CN 201358787 Y 12/2009
(Continued)

OTHER PUBLICATIONS

Office Action issued from the Indonesia Patent Office for related Application No. P-00201503290 dated Dec. 17, 2019 (3 pages including Statement of Relevance).
(Continued)

*Primary Examiner* — Jessica H Lutz
(74) *Attorney, Agent, or Firm* — Michael Best & Friedrich LLP

(57) ABSTRACT

An equalizer assembly for a mining machine includes a single piece cast equalizer having a first end and a second, opposite end. The assembly also includes a first end cap configured to be coupled to a dipper of the mining machine, the first end cap including a first bushing configured to receive the first end of the equalizer. The assembly also includes a second end cap configured to be coupled to the dipper of the mining machine, the second end cap including a second bushing configured to receive the second end of the equalizer.

17 Claims, 8 Drawing Sheets

(51) Int. Cl.
*E02F 3/407* (2006.01)
*E02F 9/00* (2006.01)

(56) References Cited

U.S. PATENT DOCUMENTS

| | | | | | |
|---|---|---|---|---|---|
| 2,034,854 | A * | 3/1936 | Lewis | E02F 3/40 | 414/722 |
| 2,652,940 | A * | 9/1953 | Brolin | E02F 3/38 | 414/716 |
| 2,947,430 | A * | 8/1960 | Schneider | B66B 7/06 | 254/400 |
| 3,402,486 | A * | 9/1968 | Branson | E02F 3/40 | 37/444 |
| 3,608,755 | A * | 9/1971 | Solokhin | E02F 3/30 | 414/690 |
| 3,843,095 | A | 10/1974 | Rupert | | |
| 4,337,614 | A * | 7/1982 | Briscoe | F16G 15/06 | 411/518 |
| 4,364,443 | A * | 12/1982 | Sato | B62D 55/0842 | 180/9.5 |
| 4,597,713 | A * | 7/1986 | Briscoe | E02F 3/30 | 414/690 |
| 5,321,902 | A * | 6/1994 | Gregory | F16H 55/36 | 254/416 |
| 5,577,858 | A * | 11/1996 | Kasim | E02F 3/58 | 403/157 |
| 5,791,809 | A * | 8/1998 | Bessey | E02F 3/58 | 403/157 |
| 6,158,917 | A * | 12/2000 | Wolin | E02F 3/3604 | 37/456 |
| 7,174,826 | B2 | 2/2007 | Kerrigan et al. | | |
| 9,784,103 | B2 * | 10/2017 | Gross | E02F 3/308 | |
| 2009/0136291 | A1 * | 5/2009 | McClanahan | E02F 3/58 | 403/156 |
| 2012/0195593 | A1 | 8/2012 | Bernasconi et al. | | |
| 2013/0133175 | A1 * | 5/2013 | Doan | E02F 3/58 | 29/525.01 |
| 2013/0136570 | A1 * | 5/2013 | Colwell | E02F 3/40 | 414/722 |
| 2013/0195593 | A1 * | 8/2013 | Knuth | E02F 3/308 | 414/697 |
| 2014/0007466 | A1 | 1/2014 | Gross et al. | | |

FOREIGN PATENT DOCUMENTS

| | | | |
|---|---|---|---|
| CN | 201696089 | U | 1/2011 |
| CN | 202170795 | U | 3/2012 |
| CN | 103132552 | A | 6/2013 |
| CN | 205025462 | U | 2/2016 |
| MX | 2012014022 | A | 5/2013 |
| RU | 2023113 | C1 | 11/1994 |
| SU | 544730 | A1 | 1/1977 |

OTHER PUBLICATIONS

Decision to Grant issued by the Russia Patent Office for related Application No. 2015120765 dated Jan. 9, 2019 (6 pages including English translation).

Second Office Action issued from the Chinese Patent Office for related Application No. 201510293961.0 dated Feb. 3, 2019 (5 pages including Statement of Relevance).

Examination Report issued by the Australia Paten Office for related Application No. 2015203866 dated Dec. 4, 2018 (4 Pages).

Technical Report issued from the Peru Patent Office for related Application No. 715.2015 dated Dec. 14, 2018 (10 pages including English Translation).

* cited by examiner

EQUALIZER FOR A MINING SHOVEL

CROSS-REFERENCE TO RELATED APPLICATIONS

This application claims priority to U.S. Provisional Application No. 62/006,450, filed Jun. 2, 2014, the entire contents which are incorporated herein by reference.

FIELD OF THE INVENTION

The present invention relates to the field of earthmoving machines. Specifically, the present invention relates to an equalizer for a mining shovel.

A conventional rope mining shovel includes a boom, a handle moveably coupled to the boom, a dipper that is coupled to the handle, an equalizer that is coupled to the dipper, and a hoist rope that is coupled to the equalizer. The hoist rope passes over a boom sheave coupled to an end of the boom, and is reeled in and paid out by a hoist drum. The equalizer aligns the hoist rope to be tangent to the boom sheave, reducing wear on the rope.

During a hoist phase, the rope is reeled in by the hoist drum, lifting the dipper upward through a bank of material and liberating the material to be dug. To release the material disposed within the dipper, a dipper door is pivotally coupled to the dipper. When not latched to the dipper, the dipper door pivots away from a bottom of the dipper, thereby freeing the material out through a bottom of the dipper.

SUMMARY

In accordance with one construction, an equalizer assembly for a mining machine includes a single piece cast equalizer having a first end and a second, opposite end. The assembly also includes a first end cap configured to be coupled to a dipper of the mining machine, the first end cap including a first bushing configured to receive the first end of the equalizer. The assembly also includes a second end cap configured to be coupled to the dipper of the mining machine, the second end cap including a second bushing configured to receive the second end of the equalizer.

In accordance with another construction, a method of coupling an equalizer to a dipper of a mining machine includes tilting an axis of rotation of the equalizer in a first direction, inserting a first end of the equalizer into a first aperture in the dipper, tilting the axis of rotation of the equalizer in an opposite, second direction, and inserting a second end of the equalizer into a second aperture in the dipper.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limited.

DETAILED DESCRIPTION

Figure 1:
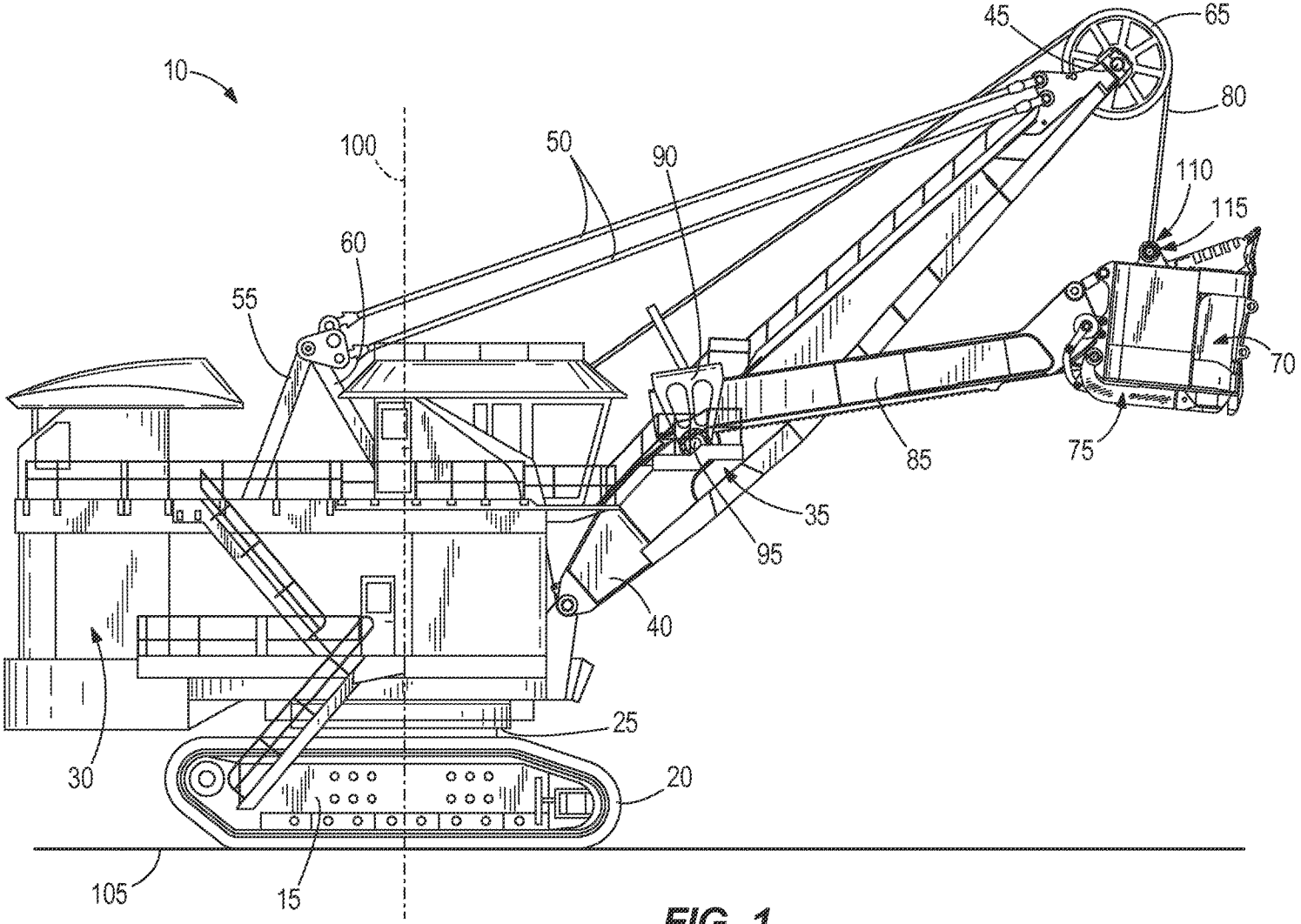
FIG. 1 is a side view of a mining shovel according to one embodiment.

FIG. 1 illustrates a power shovel 10. The shovel 10 includes a mobile base 15, drive tracks 20, a turntable 25, a revolving frame 30, a boom 35, a lower end 40 of the boom 35 (also called a boom foot), an upper end 45 of the boom 35 (also called a boom point), tension cables 50, a gantry tension member 55, a gantry compression member 60, a sheave 65 rotatably mounted on the upper end 45 of the boom 35, a dipper 70, a dipper door 75 pivotally coupled to the dipper 70, hoist ropes 80 (one shown), a winch drum (not shown), a dipper handle 85, a saddle block 90, a shipper shaft 95, and a transmission unit (also called a crowd drive, not shown). The rotational structure 25 allows rotation of the upper frame 30 relative to the lower base 15. The turntable 25 defines a rotational axis 100 of the shovel 10. The rotational axis 100 is perpendicular to a plane 105 defined by the base 15 and generally corresponds to a grade of the ground or support surface.

The mobile base 15 is supported by the drive tracks 20. The mobile base 15 supports the turntable 25 and the revolving frame 30. The turntable 25 is capable of 360-degrees of rotation relative to the mobile base 15. The boom 35 is pivotally connected at the lower end 40 to the revolving frame 30. The boom 35 is held in an upwardly and outwardly extending relation to the revolving frame 30 by the tension cables 50, which are anchored to the gantry tension member 55 and the gantry compression member 60. The gantry compression member 60 is mounted on the revolving frame 30.

The dipper 70 is suspended from the boom 35 by the hoist ropes 80. The hoist ropes 80 are wrapped over the sheave 65 and are coupled to an equalizer 110, which is coupled to the dipper 70. The hoist ropes 80 are anchored to the winch drum (not shown) of the revolving frame 30. The winch drum is driven by at least one electric motor (not shown) that incorporates a transmission unit (not shown). As the winch drum rotates, the hoist ropes 80 are paid out to lower the dipper 70 or pulled in to raise the dipper 70. The dipper handle 85 is also coupled to the dipper 70. The dipper handle 85 is slidably supported in the saddle block 90, and the saddle block 90 is pivotally mounted to the boom 35 at the shipper shaft 95. The dipper handle 85 includes a rack and tooth formation thereon that engages a drive pinion (not shown) mounted in the saddle block 90. The drive pinion is driven by an electric motor and transmission unit (not shown) to extend or retract the dipper handle 85 relative to the saddle block 90.

An electrical power source (not shown) is mounted to the revolving frame 30 to provide power to a hoist electric motor (not shown) for driving the hoist drum, one or more crowd electric motors (not shown) for driving the crowd transmission unit, and one or more swing electric motors (not shown) for turning the turntable 25. Each of the crowd, hoist, and swing motors is driven by its own motor controller, or is alternatively driven in response to control signals from a controller (not shown).

Figure 2:
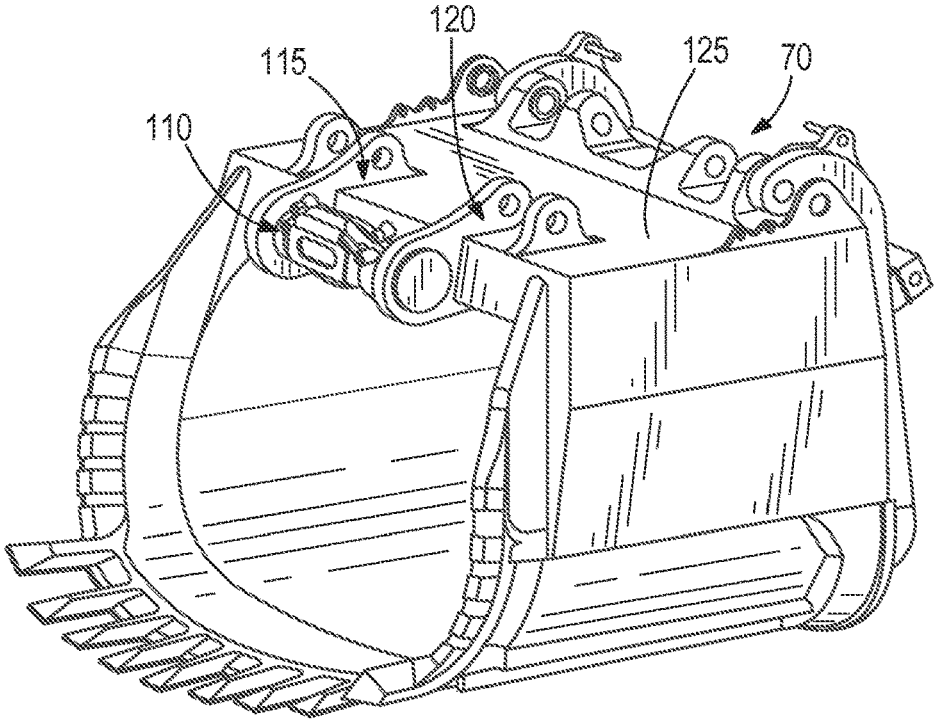
FIG. 2 is a perspective view of a portion of the mining shovel of FIG. 1, illustrating an equalizer coupled to a dipper.

With reference to FIG. 2, the dipper 70 includes a first mating projection 115 (e.g., a lug) and a second mating projection 120 (e.g., a lug) that each extend from a back wall 125 of the dipper 70. The equalizer 110 is disposed between the first and second mating projections 115, 120.

Figure 3:
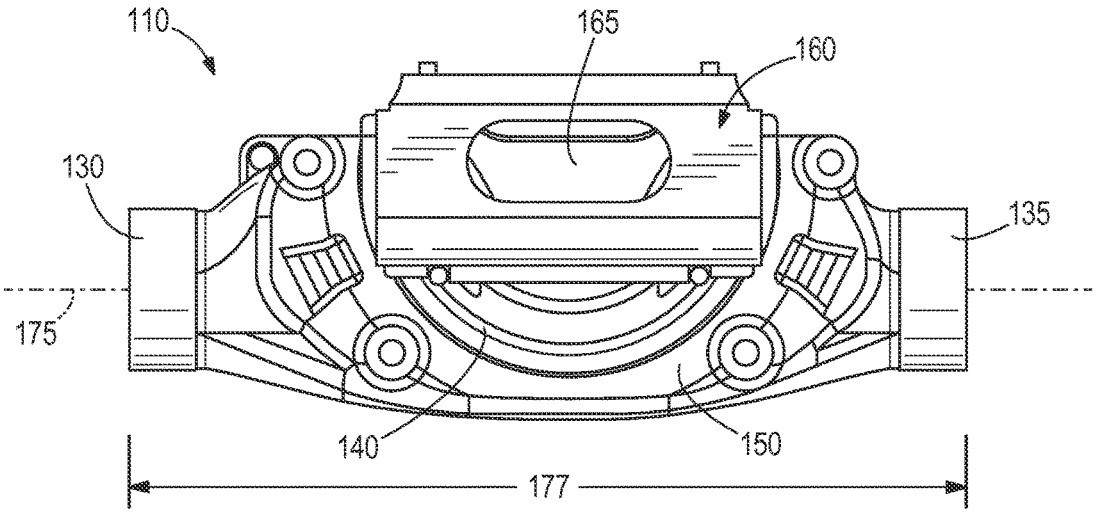
FIG. 3 is a front view of the equalizer of FIG. 2.

With reference to FIG. 3, the equalizer 110 is a single cast piece structure that includes a first end 130 and an opposite, second end 135. In the illustrated construction the first and second ends 130, 135 are cylindrical projections. The first end 130 couples to the first mating projection 115, and the second end 135 couples to the second mating projection 120.

Figure 4A:
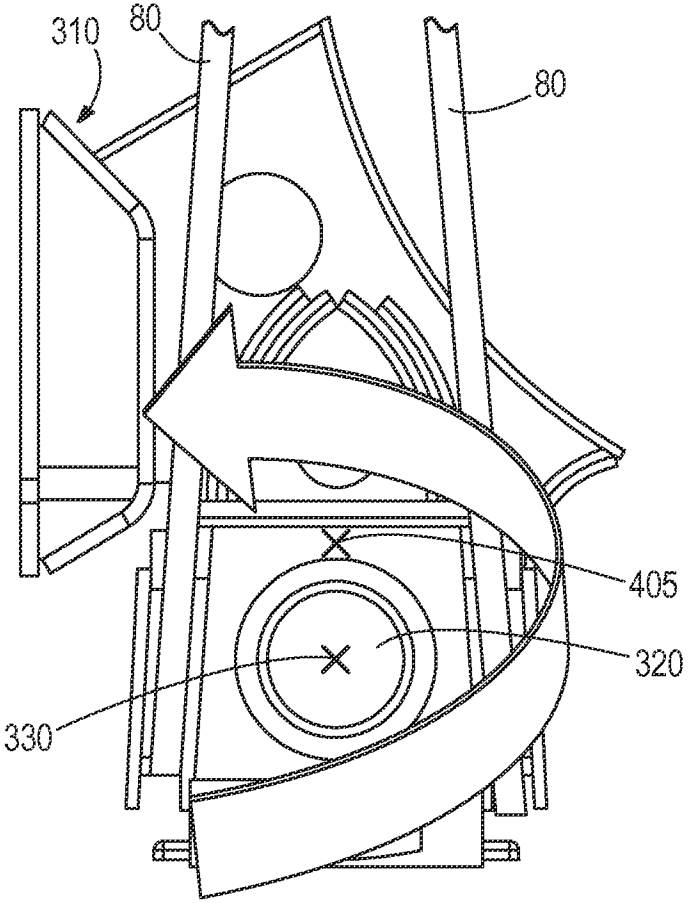
FIG. 4A is a comparison side view of the equalizer of FIG. 2A.
Figure 4:
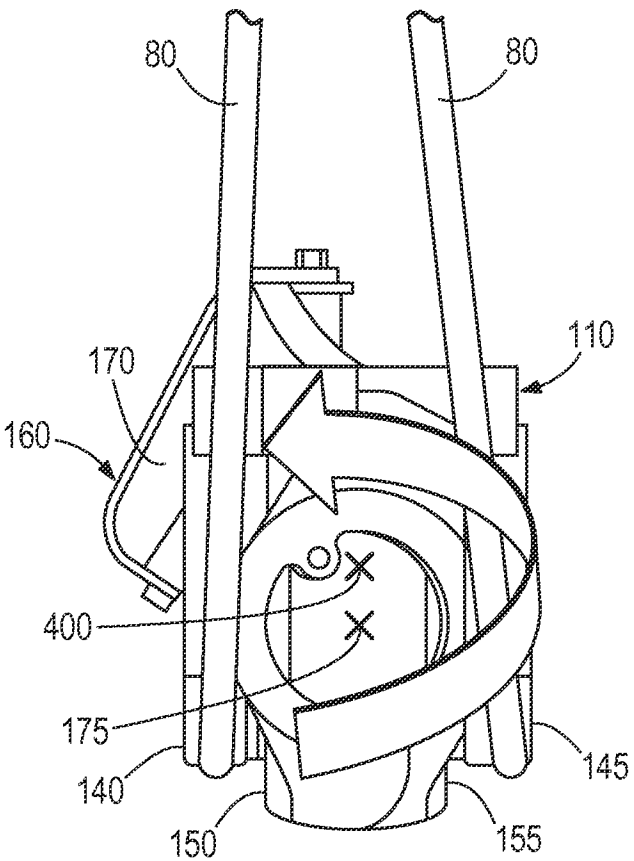
FIG. 4 is a side view of the equalizer of FIG. 2, illustrating guide ropes coupled to the equalizer, and an overturn moment.

With reference to FIGS. 3 and 4, the equalizer 110 includes a first rope-receiving element 140 (FIGS. 3 and 4) and a second rope-receiving element 145 (FIG. 4). Both of the rope-receiving elements 140, 145 are disposed between the first and second ends 130, 135. The first rope-receiving element 140 is disposed on a front side 150 of the equalizer 110, and the second rope-receiving element 145 is disposed on a back side 155 of the equalizer 110. In the illustrated construction, the first and second rope-receiving elements 140, 145 are D-shaped projections integrally formed along the front and back sides 150, 155. The first and second rope-receiving elements 140, 145 receive and guide the hoist ropes 80. In some constructions, the rope-receiving elements 140, 145 include a groove or grooves that receive the hoist ropes 80. In some constructions, the rope-receiving elements 140, 145 include other shapes other than that illustrated (e.g., circular, oval, etc.). The rope-receiving elements 140, 145 support the hoist ropes 80, and align the hoist ropes 80 to be tangent to the sheave 65, thus reducing wear on the hoist ropes 80.

With continued reference to FIGS. 3 and 4, the equalizer 110 further includes a shield element 160. The shield element 160 is disposed on the front side 150 of the equalizer 110. The shield element 160 is a sacrificial element that protects the remainder of the equalizer 110 from contacting the sheave 65 and damaging the equalizer 110. The shield element 160 absorbs contact against the sheave 65 in the event that the dipper 70 and equalizer 110 are close to the sheave 65 (e.g., when the hoist ropes 80 are pulled tight). In the illustrated construction, the shield element 160 is a thin plate having an opening 165 (FIG. 3). As illustrated in FIG. 4, at least a portion of the shield element 160 extends at a slight angle relative to the rope-receiving element 140, and is spaced along substantially the entire shield element 160 from the rope receiving element 140, thereby forming a gap 170 between the shield element 160 and the rope-receiving element 140. At least a portion of the shield element 160 bends and/or flexes into the gap 170 when the shield element 160 contacts the sheave 65. Other constructions include different shapes, orientations, and locations for the shield element 160.

With reference to FIG. 3, the equalizer 110 includes an axis of rotation 175. Once coupled to the dipper 70, the equalizer 110 is able to rotate about the axis of rotation 175. In some constructions, the equalizer 110 is able to rotate up to approximately 180 degrees about the axis of rotation 175. In other constructions, the equalizer 110 is able to rotate farther than 180 degrees.

With reference to FIGS. 3 and 5-7, the equalizer 110 has an overall length 177 (FIG. 3), as measured along the axis of rotation 175, that is greater than a gap 178 (FIGS. 5-7) that extends between the first and second mating projections 115, 120 on the dipper 70.

Figure 5:
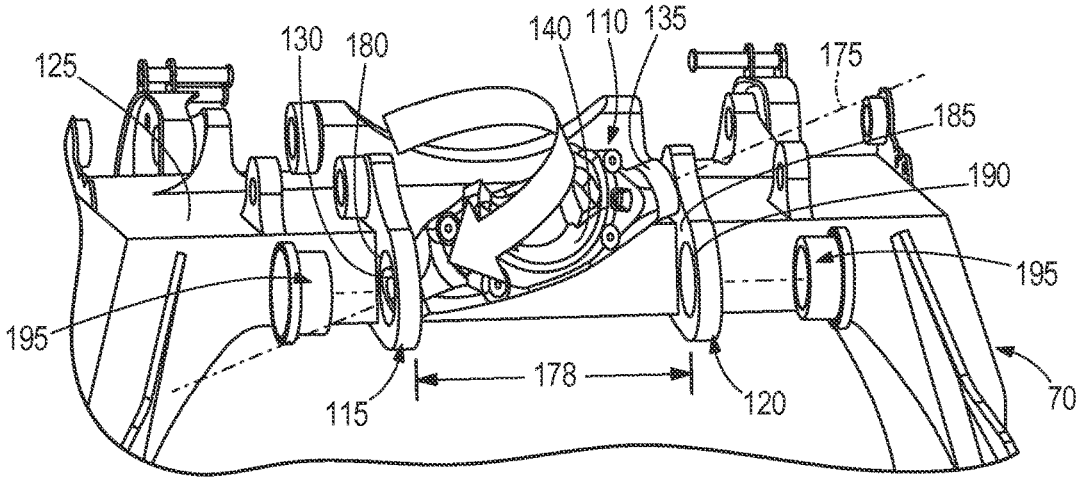
FIGS. 5-7 are perspective views of the equalizer of FIG. 2 being coupled to the dipper.
Figure 6:
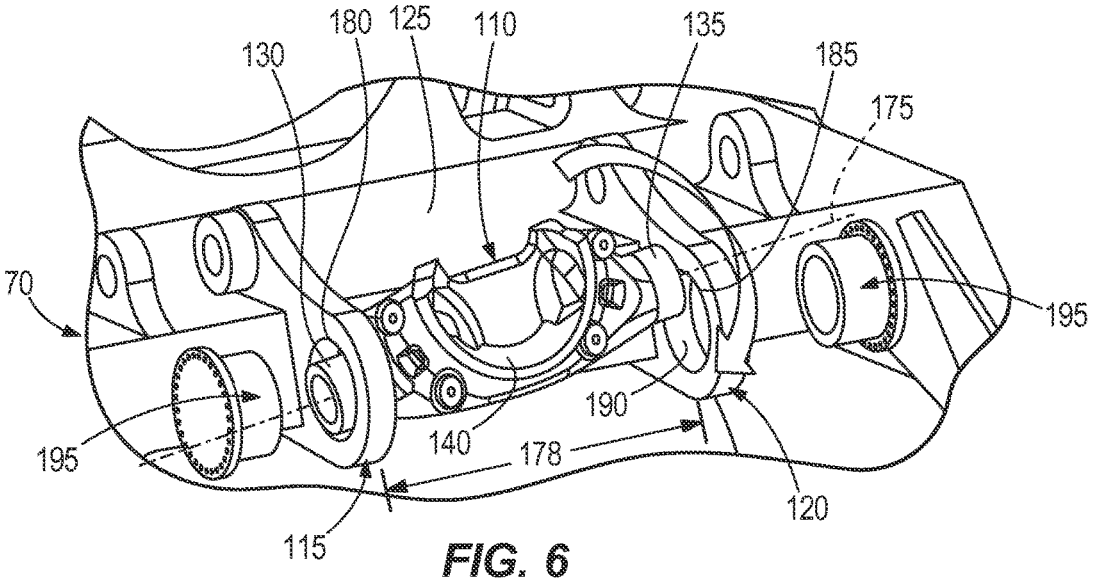
Figure 7:
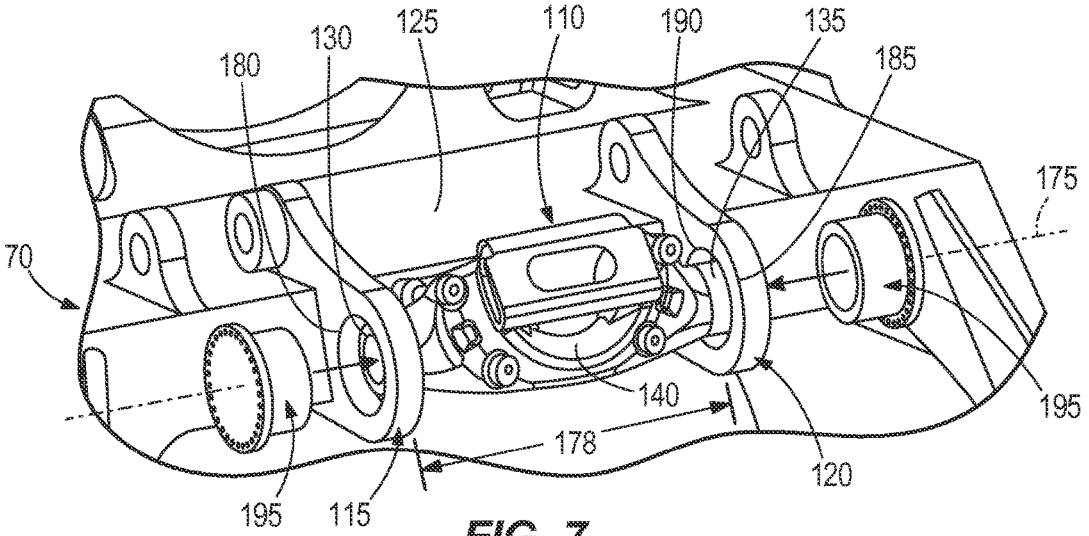

With reference to FIGS. 5-7, the equalizer 110 is coupled to the dipper through a series of four steps. In the first step, illustrated in FIG. 5, the equalizer 110 and the axis of rotation 175 are both tilted in a first direction, such that the first end 130 is lowered and is able to slide partially into an aperture 180 on the first mating projection 115.

In the second step, illustrated in FIG. 6, the equalizer 110 and the axis of rotation 175 are both tilted back in an opposite direction, such that the first end 130 is lifted up and is able to slide farther into the aperture 180, and such that the second end 135 is able to slide down along and adjacent to an inside surface 185 of the second mating projection 120 toward a second aperture 190 on the second mating projection 120.

In the third step, illustrated in FIG. 7, the equalizer 110 and the axis of rotation 175 are tilted back farther, such that the second end 135 is able to slide fully into the second aperture 190.

Figure 8:
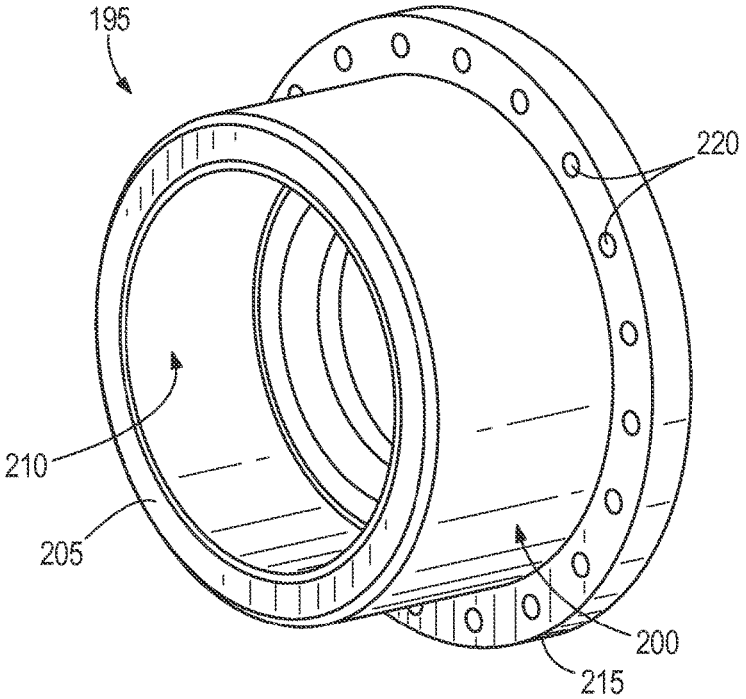
FIG. 8 is a perspective view of an end cap used to receive an end of the equalizer of FIG. 2.
Figure 9:
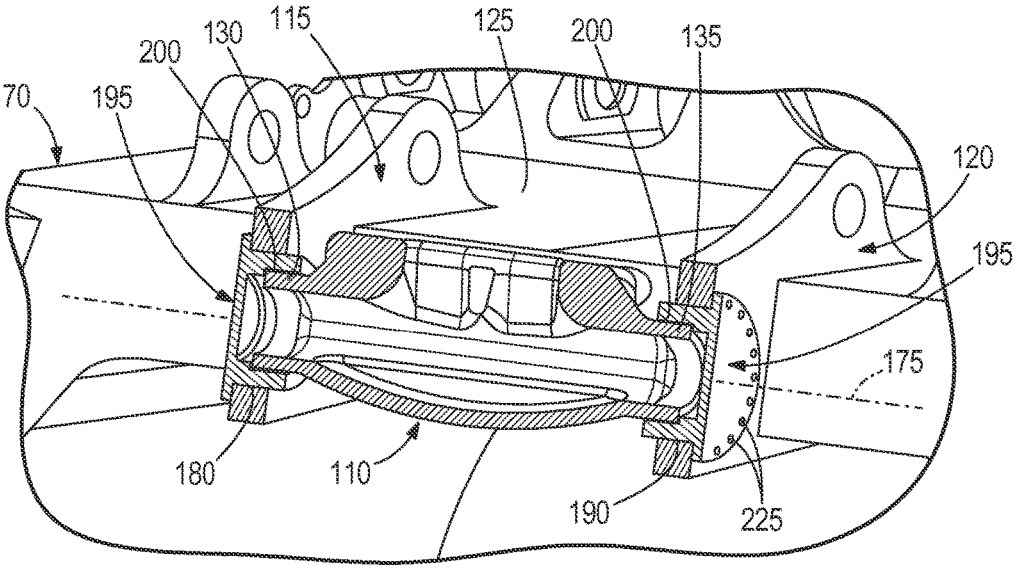
FIG. 9 is a cross-sectional view of the equalizer of FIG. 2, coupled to the dipper.

In the fourth step, illustrated in FIGS. 7-9, end caps 195 (e.g., bushing cartridges) are coupled to the first and second mating projections 115, 120. The illustrated end caps 195 control both an axial and radial location of the equalizer 110. As illustrated in FIG. 8, each of the end caps 195 includes a housing 200, a seal 205 disposed radially inward of the housing 200, and a bushing 210 disposed radially inward of the seal 205. The housing 200 includes an outer flange 215 that includes apertures 220. Other constructions of the end cap 195 include different numbers and arrangements of flanges 215 and apertures 220. In some constructions, the end cap 195 does not include a seal 205, or includes a different type of seal 205 than that shown.

With reference to FIG. 9, fasteners 225 are inserted through the apertures 220 to fasten the end caps 195 to the first and second mating projections 115, 120, thereby locking the equalizer 110 between the first and second mating projections 115, 120 along the axis of rotation 175, but still allowing the equalizer 110 to rotate about the axis of rotation 175. As illustrated in FIG. 9, the bushings 210 receive the first and second ends 130, 135 and allow the first and second ends 130, 135, and the equalizer 110 as whole, to rotate about the axis of rotation 175 relative to the dipper 70.

Figure 2A:
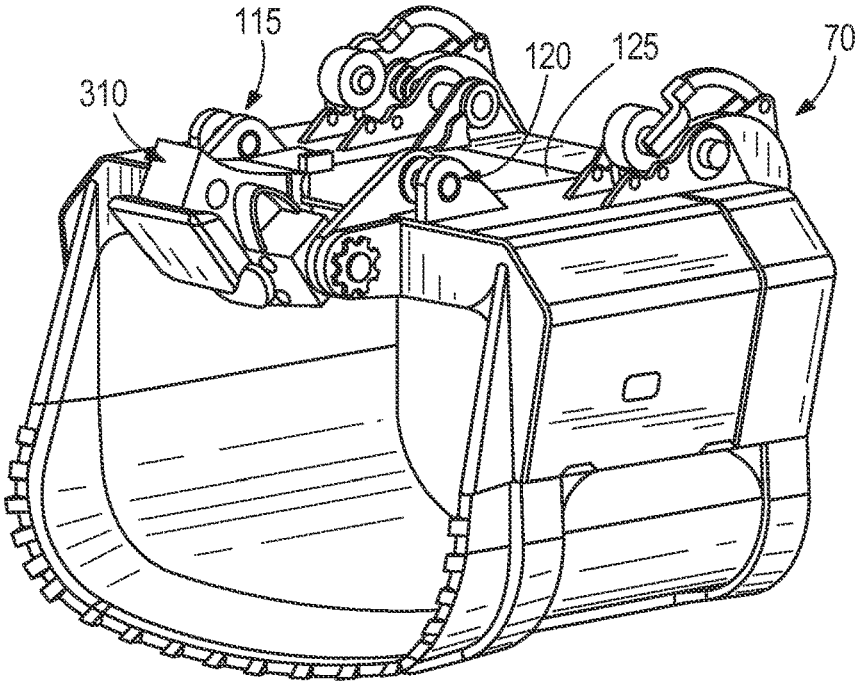
FIG. 2A is a perspective comparison view of a commonly-used equalizer.
Figure 3A:
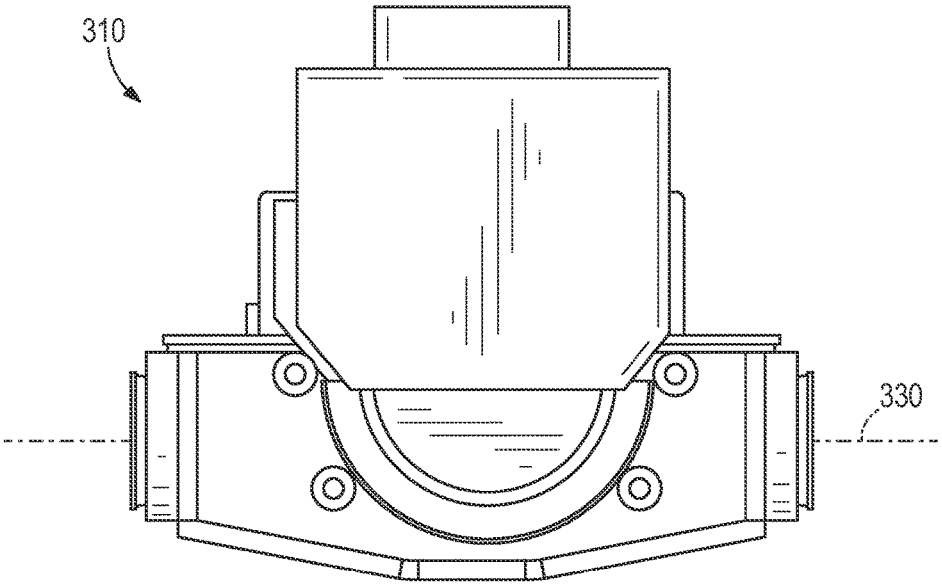
FIG. 3A is a comparison front view of the equalizer of FIG. 2A.

The equalizer 110 provides advantages over a more traditional pin-type equalizer, such as the equalizer 310 illustrated in FIGS. 2A, 3A, 4A, and 9A. For example, and as illustrated in FIGS. 2A and 3A, the equalizer 310 is a large, fabricated, machined structure used to connect hoist ropes to a dipper. The equalizer 310 is generally larger and bulkier than the equalizer 110 illustrated in corresponding FIGS. 2 and 3. In some constructions, the equalizer 310 weighs approximately 8000 lbs more than the equalizer 110. In some constructions, the equalizer 310 weighs approximately 10,500 lbs, whereas the equalizer 110 weighs approximately 3700 lbs. In some constructions, the equalizer 110 weighs between approximately 3500 lbs and 4000 lbs. Other constructions include different ranges. This weight savings translates directly into improved cutting force and higher payloads for the shovel 10.

Figure 9A:
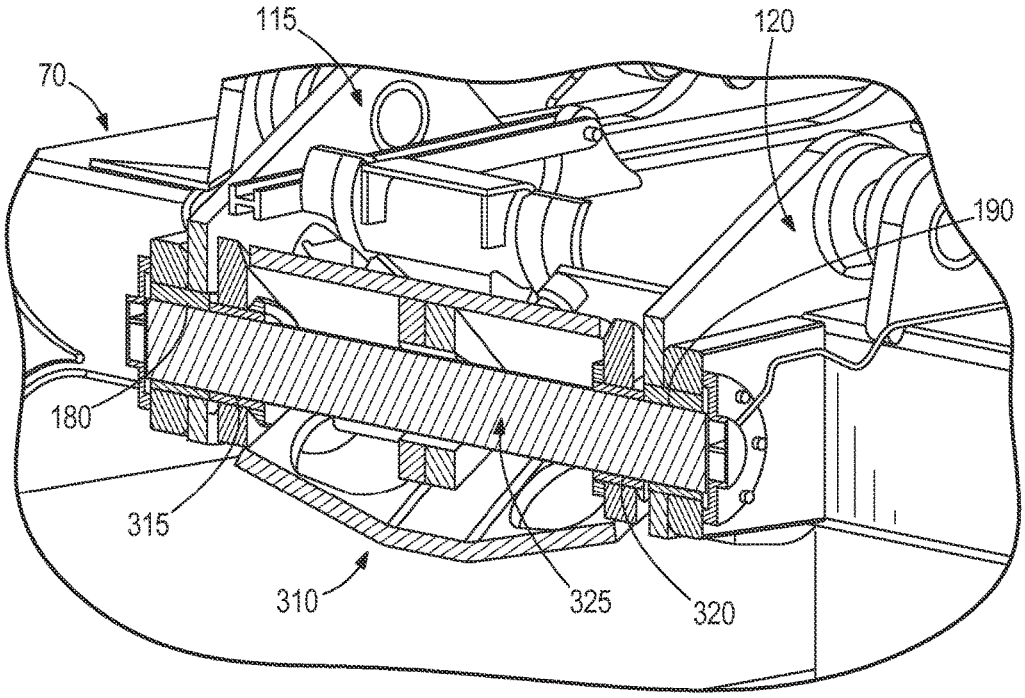
FIG. 9A is a comparison cross-sectional view of the equalizer of FIG. 2A, coupled to the dipper.

As illustrated in FIGS. 4A and 9A, the equalizer 310 includes apertures 315, 320 on either end of the equalizer 310. To assemble the equalizer 310, a pin 325 (e.g., 9 feet long, and weighing approximately 1200 lbs) is inserted through the apertures 315, 320 and through the apertures 180, 190 on the first and second mating projections 115, 120. The combination of both the equalizer 310 and the pin 325 is disadvantageously heavy, and only a small portion (e.g., less than 4 feet) of the pin 325 ends up being used as a bearing surface about which the equalizer 310 and the dipper 70 rotate relative to one another. Inserting the pin 320 is also difficult and time-consuming because of the need to align the apertures 315, 320, 180, and 190 before inserting the pin 325, combined with the overall weight of the components being aligned.

In contrast, and as described above, the equalizer 110 is integrally cast as a single piece of material, with two cylindrical, opposed ends 130, 135 that project axially along the axis of rotation 175 and are sized to be received within the bushings 210. In some constructions the ends 130, 135 are non-cylindrical (e.g., have more of a tapered design) to correspond with a similarly shaped non-cylindrical bushing 210. The equalizer 110, by itself, takes the place of the pin 325 due to the first and second ends 130, 135 being rotatably received and disposed within the bushings 210. In some constructions, a dipper and equalizer system includes only the dipper, the equalizer 110, and the two end caps 195. This combination of the dipper, the equalizer 110, and the two end caps 195, without the need for a further pin, is sufficient for relative rotational motion of the dipper 70 and the equalizer 110. In some constructions, the single piece cast equalizer 110 and the end caps 195 together form a kit assembly that can be used on a variety of different mining machines (e.g., as a retrofit or provided as an after-market product)

The assembly steps for the equalizer 110 are easier and faster than the assembly steps for the equalizer 310 and the pin 325, at least in part because there is no pin required to attach the equalizer 110 to the dipper 70. Only the end caps 195 are added once the equalizer 110 has been inserted into the apertures 180, 190. However, in some constructions, the equalizer 110 may be fitted with a pin, similar to the pin 325, to facilitate rotational motion of the equalizer 110 and dipper 70. For example, in some constructions a pin is extended through the first and second ends 130, 135 along the axis of rotation 175, and the pin alone (or in combination with the first and second ends 130, 135) enables rotation of the equalizer 110 and dipper 70.

With reference to FIGS. 4 and 4A, the equalizer 110 also includes a center of gravity 400 that is closer to the axis of rotation 175 than a center of gravity 405 of the equalizer 310 is to an axis of rotation 330. For example, in some constructions, the center of gravity 400 for the equalizer 110 is only 4 inches from the axis of rotation 175, while the center of gravity 405 for the equalizer 310 is 8 inches from the axis of rotation 330. Because of the close proximity of the center of gravity 400 to the axis of rotation 175, there is very little overturning moment (defined as the product of the weight of the equalizer and the distance of the center of gravity from the axis of rotation) on the equalizer 110. This makes it difficult to kink the hoist ropes 80, since the overturning moment is small. In some constructions, the overturning moment of the equalizer 110 is roughly 86% less than the equalizer 310. In some constructions, the overturning moment for the equalizer 110 is approximately 1200 ft-lbs, whereas the overturning moment for the equalizer 310 is approximately 7,000 ft-lbs. In some constructions, the overturning moment for the equalizer 110 is between approximately 1100 ft-lbs and 1300 ft-lbs. Other constructions include different ranges.

Figure 10:
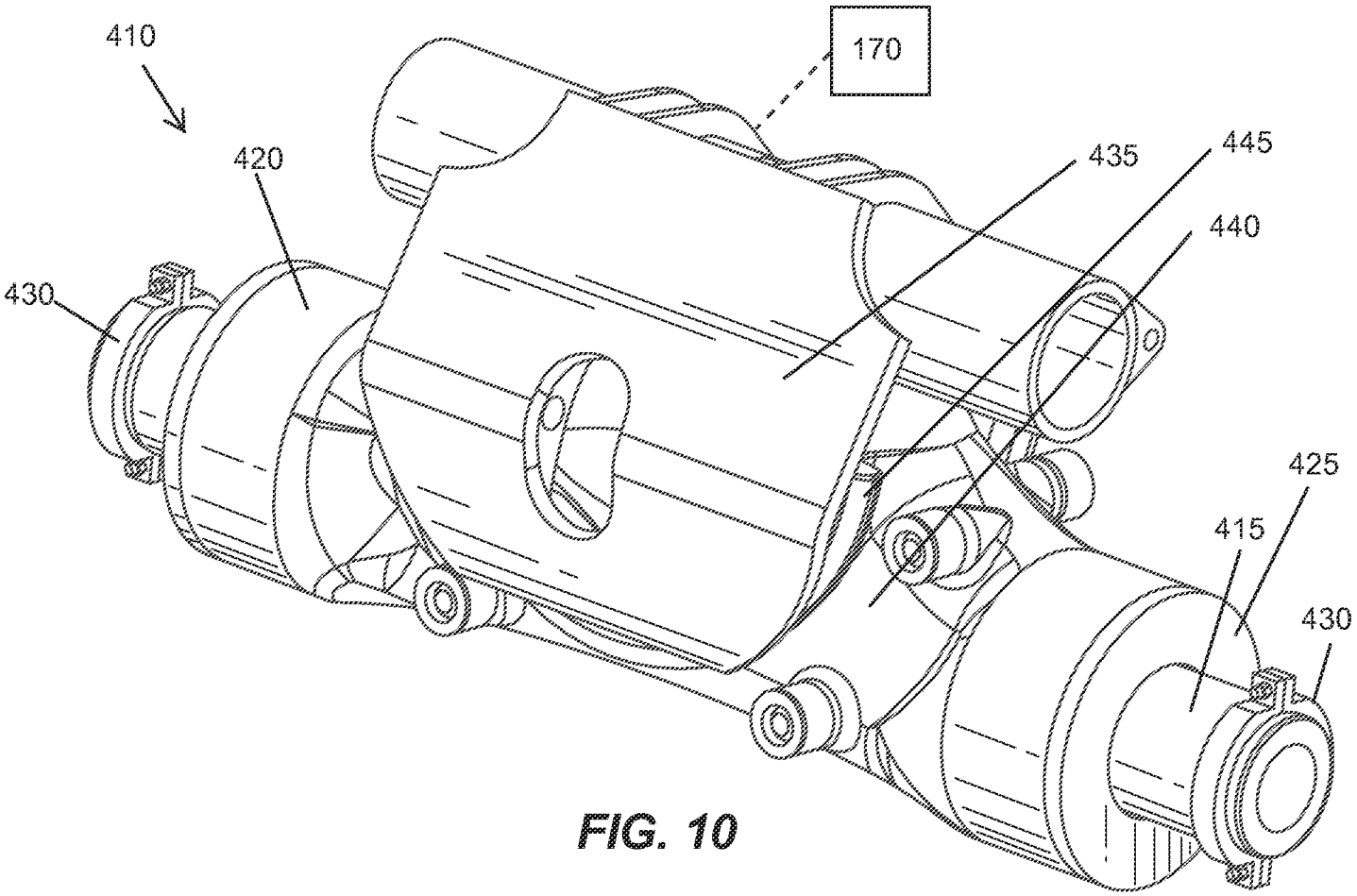
FIG. 10 is a perspective view of an equalizer according to another construction.

FIG. 10 illustrates an alternative equalizer 410. The equalizer 410 is configured to be coupled to the dipper 70. In some constructions the equalizer is a cast structure. As illustrated in FIG. 10, a single pin 415 extends through the equalizer 410, and out of ends 420 and 425. Clamp elements 430 are coupled to ends of the pin 415, to prevent or inhibit the pin 415 from sliding out of the equalizer 410. Similar to the equalizer 110, the equalizer 410 includes a shield element 435. The shield element 435 is disposed on a front side 440 of the equalizer 410. The shield element 435 is a sacrificial element that protects the remainder of the equalizer 410 from contacting the sheave 65 and damaging the equalizer 410. The shield element 435 absorbs contact against the sheave 65 in the event that the dipper 70 and equalizer 410 are close to the sheave 65 (e.g., when the hoist ropes 80 are pulled tight). The equalizer 410 also includes at least one rope-receiving element 445.

In some constructions, the ends 420, 425 of the equalizer 410 are configured to slide into the apertures 180, 190 (e.g., in a similar manner to the way the equalizer 110 described above slides into the apertures 180, 190), prior to insertion of the pin 415 and then the coupling of the clamp elements 430 to the pin 415.

Although the invention has been described in detail with reference to certain preferred embodiments, variations and modifications exist within the scope and spirit of one or more independent aspects of the invention as described.

What is claimed is:

1. An equalizer system for a mining machine, the equalizer system comprising:

an equalizer assembly having a first end and a second, opposite end;

a first, single piece end cap having a first end and a second, opposite end spaced from the first end along an axis, the first end cap configured to be coupled directly to a dipper of the mining machine, the first end cap having a first hollow, cylindrical bushing portion configured to directly receive the first end of the equalizer assembly, the first hollow, cylindrical bushing portion being open at the first end of the first end cap, the first end cap further including a circumferential flange portion at the second end of the first end cap, the circumferential flange portion including a plurality of apertures configured to receive fasteners to fasten the first end cap to the dipper; and a second, single piece end cap configured to be coupled directly to the dipper of the mining machine, the second end cap having a second hollow, cylindrical bushing portion configured to receive the second end of the equalizer assembly.

2. The equalizer system of claim 1, wherein the second end of the first end cap is closed.

3. The equalizer system of claim 1, wherein the first end and the second end of the equalizer assembly are separate projections sized and shaped to be received separately in the first and second end caps, respectively.

4. The equalizer system of claim 1, wherein the equalizer assembly includes a first rope-receiving element and a second rope-receiving element, each of the first and second rope-receiving elements disposed between the first and second ends of the equalizer assembly.

5. The equalizer system of claim 1, wherein the equalizer assembly includes a shield element disposed on a front side of the equalizer assembly, wherein the shield element includes a plate that is spaced from a portion of the equalizer assembly and is a sacrificial element that protects the portion of the equalizer assembly from contacting a sheave on the mining machine.

6. A mining machine that includes the equalizer system of claim 1, wherein the mining machine includes a dipper, wherein the dipper includes a main body and first and second mating projections that are fixed rigidly and extend from the main body, and wherein the first and second end caps are coupled directly to the first and second mating projections.

7. The mining machine of claim 6, wherein the main body is sized and shaped to receive material during a digging operation.

8. The mining machine of claim 7, wherein the first mating projection includes a first aperture, and wherein the first hollow, cylindrical bushing portion is disposed within the first aperture.

9. The mining machine of claim 8, wherein the first mating projection includes a first outer surface, and the second mating projection includes a second outer surface, wherein the first outer surface faces opposite the second outer surface, wherein the circumferentially-extending flange portion of the first end cap is disposed outside of the first aperture along the first outer surface and is disposed axially adjacent the first hollow cylindrical bushing portion, such that the first end of the equalizer assembly extends axially into the first hollow cylindrical bushing portion and terminates inside both the first hollow cylindrical bushing portion and the first aperture.

10. The mining machine of claim 8, wherein the equalizer includes a central portion that has a width greater than a diameter of each of the first aperture and the second aperture.

11. The mining machine of claim 8, wherein the equalizer assembly includes an axis of rotation that extends through the first and second apertures.

12. The mining machine of claim 7, wherein a distance between the first mating projection and the second mating projection defines a gap, and wherein a distance between the first end of the equalizer assembly and the second end of the equalizer assembly is greater than the gap.

13. The mining machine of claim 6, wherein the first and second end caps extend at least partially through portions of the dipper and extend over the first and second ends of the equalizer assembly.

14. The equalizer system of claim 1, wherein the equalizer assembly includes a main body formed of a single-piece casting.

15. The equalizer system of claim 14, wherein the main body includes a first rope-receiving element and a second rope-receiving element, each of the first and second rope-receiving elements being disposed between the first and second ends of the equalizer assembly, wherein the first rope-receiving element is a D-shaped projection.

16. The equalizer system of claim 14, wherein the equalizer assembly includes a pin coupled within the main body.

17. The equalizer system of claim 16, wherein the pin is rotatably coupled to the main body and extends from the main body on opposite ends of the main body, forming the first and second ends of the equalizer assembly.

* * * * *